US006758764B1

(12) United States Patent
Chen et al.

(10) Patent No.: US 6,758,764 B1
(45) Date of Patent: Jul. 6, 2004

(54) WEIGHT MEMBER FOR A GOLF CLUB HEAD

(75) Inventors: Chan-Tung Chen, Kaohsiung (TW); Yan-Zheng Su, Tainan Hsien (TW)

(73) Assignee: Nelson Precision Casting Co., Ltd., Kaohsiung (TW)

( * ) Notice: Subject to any disclaimer, the term of this patent is extended or adjusted under 35 U.S.C. 154(b) by 0 days.

(21) Appl. No.: 10/611,995

(22) Filed: Jul. 3, 2003

(51) Int. Cl.[7] ..... A63B 53/04; A63B 53/06; A63B 53/08

(52) U.S. Cl. ..... 473/349; 473/324; 420/52; 420/96; 420/97; 420/108; 420/113; 420/453; 420/584.1; 420/586.1; 148/427; 148/442; 148/327; 148/333; 148/335

(58) Field of Search ..... 420/52, 96, 97, 420/108, 113, 453, 584.1, 586.1; 148/427, 442, 327, 333, 335; 473/324, 349

(56) References Cited

U.S. PATENT DOCUMENTS 4,692,305 A * 9/1987 Rangaswamy et al. ..... 420/436
5,938,543 A * 8/1999 McGeeney et al. ..... 473/324
6,200,688 B1 * 3/2001 Liang et al. ..... 428/544
6,475,427 B1 * 11/2002 Deshmukh et al. ..... 419/8
6,478,897 B1 * 11/2002 Izumida et al. ..... 148/428
2003/0000341 A1 * 1/2003 Amick ..... 75/352

FOREIGN PATENT DOCUMENTS

JP 59-70744 * 4/1984 ..... 420/448

OTHER PUBLICATIONS

Derwent Abstract 2003–842132 for Patent Document No. TW537916A Jun. 2003.*

* cited by examiner

*Primary Examiner*—John P. Sheehan
(74) *Attorney, Agent, or Firm*—Bacon & Thomas

(57) ABSTRACT

A weight member for a golf club head is made of a WFeNi alloy by a precision casting process. The WFeNi alloy includes nickel 30–60 wt %, tungsten 15–30 wt %, chromium 1.5–10.0 wt %, and iron that is the remaining portion. Chromium improves the rust resisting property of the weight member and lengthens the life of the weight member. Uniformity of shining finishing of the weight member can be improved by controlling a mixture ratio of nickel to tungsten. Silicon may be added to improve the flowability of the molten metal. Manganese, copper, vanadium, and niobium may be added to improve the mechanical properties of the weight member.

11 Claims, 3 Drawing Sheets

WEIGHT MEMBER FOR A GOLF CLUB HEAD

BACKGROUND OF THE INVENTION

1. Field of the Invention

The present invention relates to a weight member. In particular, the present invention relates to a weight member for a golf club head.

2. Description of Related Art

A conventional weight member for a golf club head is made by powder metallurgy in which metal powders of high density and high rigidity such as tungsten having a density of 19.30 g/cm$^3$, iron having a density of 7.8 g/cm$^3$, and nickel having a density of 8.9 g/cm$^3$ are pressed and formed and then sintered to form a WFeNi alloy that forms the weight member for a golf club head. Although the powder metallurgy is widely used, several disadvantages exist, including: high cost for molds, low stretchability of products, long processing time, aptness to thermal expansion/shrinkage, and difficulty in forming delicate patterns, letters, serial number, trade names, etc.

Another method for manufacturing a weight member made of WFeNi alloy includes a precision casting process in which a specific metal melting sequence and a specific composition ratio are utilized to prevent sedimentation of tungsten having a high melting point. In the precision casting process, nickel of 30%–50%, iron of 30%–50%, tungsten of 20%–35%, silicon of less than 1%, manganese of less than 1%, and niobium of less than 0.5% are fed into a high-temperature furnace at a temperature above 1450° C. and melt to form a weight weight member made of WFeNi alloy for a golf club head. The weight member is then embedded or welded to a golf club head body that is generally made of stainless steel, such as stainless steel of SUS304, 17-4, and 4130 series.

This precision casting process overcomes the problems of the above conventional powder metallurgy. However, as illustrated in FIGS. 1 and 2 of the drawings, if the mixture ratio of the nickel, iron, and tungsten was not properly controlled, a pearlite structure was precipitated in a base of a γ (iron, nickel) phase of the WFeNi alloy, deteriorating the rust-resisting property of the weight member. The upper portion above a horizontal welding line in FIG. 1 of the drawings shows the weight member made of WFeNi alloy, and the lower portion below the horizontal welding line is the base material of the weight member. FIG. 2 is an enlarged view of the pearlite structure. During spray testing at 40° C. for 24 hours (which simulates a highly corrosive environment) to the WFeNi alloy by using NaCI solution of 5% by weight, the rusted area of the WFeNi alloy often exceeded 8% of the overall surface area of the WFeNi alloy.

Further, as illustrated in FIG. 3, since tungsten was often precipitated on the surface of the WFeNi alloy (the deep color portion is the pearlite structure and the white portion surrounded by the pearlite structure is the precipitated tungsten), the tungsten/γ (iron, nickel) phase formed by the alloy caused patterns on the weight member made of WFeNi alloy after grinding and polishing procedures. As a result, the appearance of the polished weight member was adversely affected. Further, an obvious insertion line was generated when the weight member made of WFeNi alloy was directly embedded into a bottom surface of a golf club head body. Further, the insertion line of the products varied in response to the thickness ground off, the angle of grinding. Thus, it is difficult to control the processing conditions.

OBJECTS OF THE INVENTION

An object of the present invention is to provide a weight member for a golf club head, wherein chromium is added during the precision casting process to prevent the pearlite structure from being precipitated in the γ (iron, nickel) phase of the WFeNi alloy that forms the weight member, thereby improving the rust-resisting property of the weight member.

Another object of the present invention is to provide a weight member for a golf club head, wherein the mixture ratio of nickel to tungsten is controlled during the precision casting process to prevent the pearlite structure from being precipitated in the γ (iron, nickel) phase of the WFeNi alloy that forms the weight member, thereby providing an aesthetically pleasing appearance of the resultant golf club head to which the weight member is directly engaged. The uniformity of the shining finishing, the appearance, and the assembling tolerance of the weight member are improved.

A further object of the present invention is to provide a weight member for a golf club head, wherein silicon is added during the precision casting process to prevent poor flowability of the poured molten metal, thereby improving the efficiency of the process.

Still another object of the present invention is to provide a weight member for a golf club head, wherein manganese, copper, vanadium, and niobium are added during the precision casting process to increase the flowability of the poured molten metal and to assist in removal of gas, thereby improving the mechanical strength of the weight member.

SUMMARY OF THE INVENTION

To achieve the aforementioned objects, the present invention provides a weight member for a golf club head that is made of a WFeNi alloy by a precision casting process. The WFeNi alloy includes nickel 30–60 wt %, tungsten 15–30 wt %, chromium 1.5–10.0 wt %, and iron that is the remaining portion. Chromium improves the rust-resisting property of the weight member and lengthens the life of the weight member. Uniformity of shining finishing of the weight member can be improved by controlling a mixture ratio of nickel to tungsten. Silicon may be added to improve the flowability of the molten metal. Manganese, copper, vanadium, and niobium may be added to improve the mechanical properties of the weight member.

Other objects, advantages and novel features of this invention will become more apparent from the following detailed description when taken in conjunction with the accompanying drawings.

DETAILED DESCRIPTION OF THE PREFERRED EMBODIMENT

Figure 1:
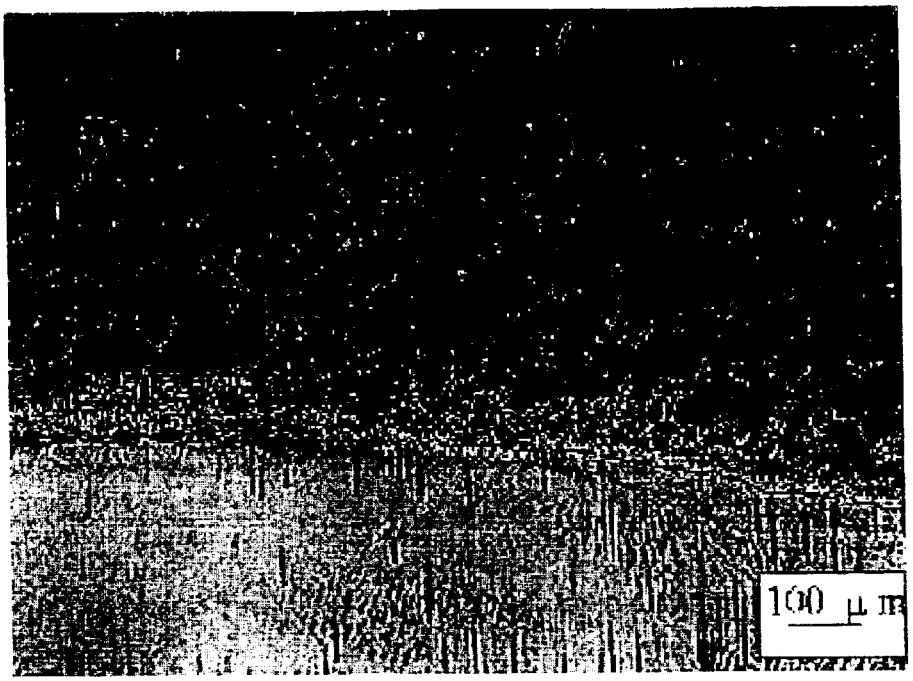
FIG. 1 PRIOR ART
FIG. 1 is a microphoto showing a pearlite structure and cracks generated during welding of a conventional weight member of WFeNi alloy to a golf club head body.
Figure 2:
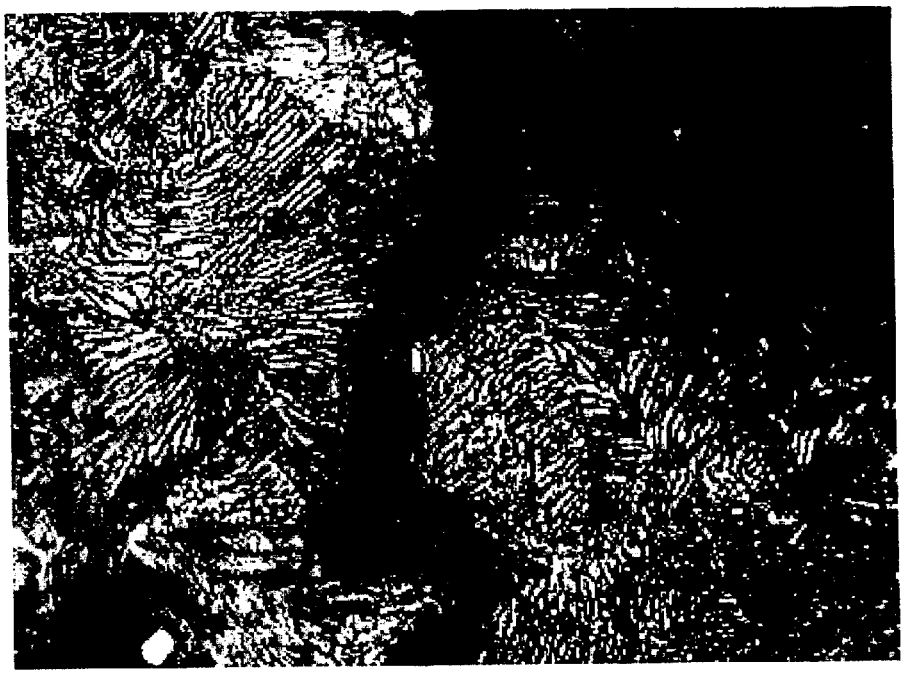
FIG. 2 PRIOR ART
FIG. 2 is an enlarged view of a portion of the pearlite structure and cracks in FIG. 1.
Figure 3:
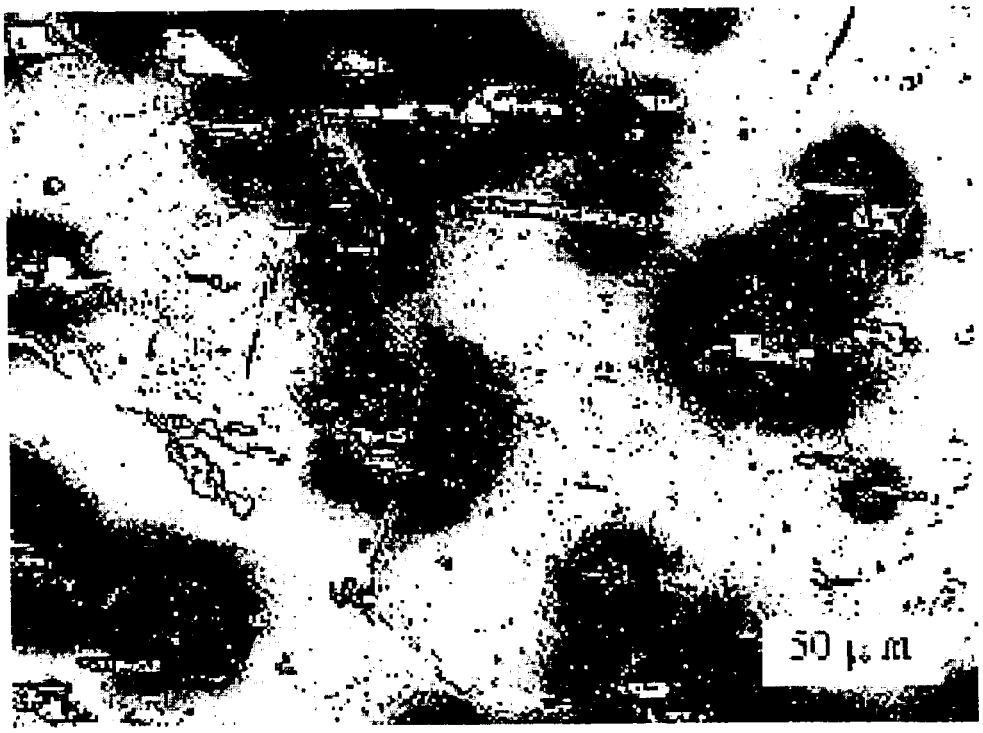
FIG. 3 PRIOR ART
FIG. 3 is a microphoto showing a pearlite structure and tungsten precipitated from a conventional WFeNi alloy made weight member for a golf club head.
Figure 4:
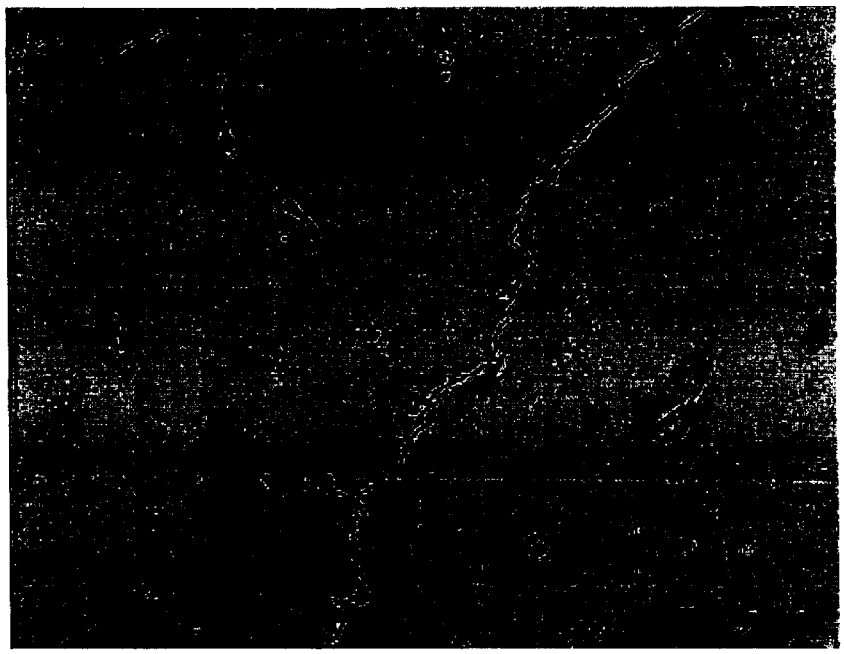
FIG. 4 is a microphoto of a WFeNi alloy made weight member for a golf club head in accordance with the present invention, wherein the WFeNi alloy includes chromium.
Figure 5:
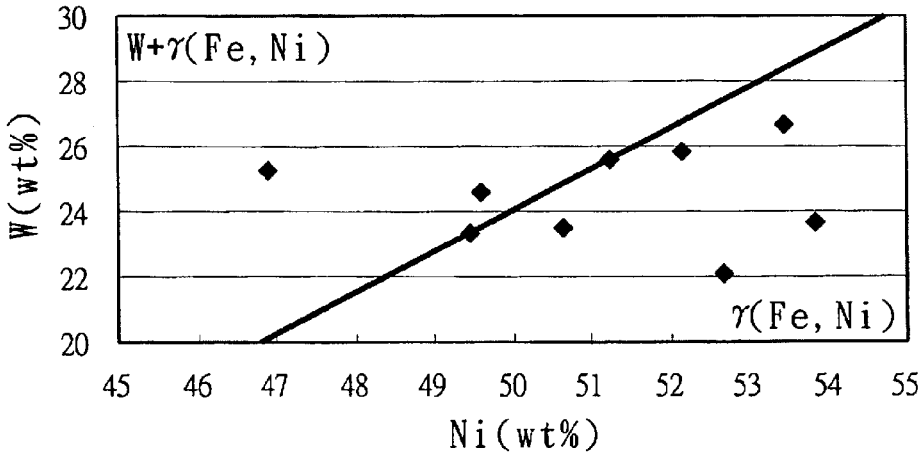
FIG. 5 is a solidus curve of tungsten precipitated from the γ (iron, nickel) phase of WFeNi alloy that forms the weight member for a golf club head in accordance with the present invention.

A preferred embodiment of the present invention is now to be described hereinafter in detail FIG. 4 is a microphoto of a WFeNi alloy made weight member for a golf club head in accordance with the present invention, wherein the WFeNi alloy includes chromium. FIG. 5 is a solidus curve of tungsten precipitated from the γ (iron, nickel) phase of WFeNi alloy that forms the weight member for the golf club head in accordance with the present invention.

Most procedures of the method for manufacturing the weight member for a golf club head in accordance with the present invention are identical to those of the precision casting process mentioned in the background of the invention and therefore not described again to avoid redundancy.

The weight member for a golf club head in accordance with the present invention is preferably manufactured by means of precision casting process. In the precision casting process, metals are fed into a high-temperature furnace at a temperature between 1450° C. and 1750° C. (preferably 1660° C.-1680° C.), and chromium is added while controlling the mixture ratio of nickel to tungsten, thereby forming a molten WFeNi alloy. Next, the molten WFeNi alloy is poured into a preheated mold with a specific shape, precise patterns, and letters. The preheating temperature for the mold is set between 950° C. and 1300° C. Thus, a weight member for a golf club head is made by precision casting process. The weight member is then engaged (preferably by embedding and soldering) to a golf club head body.

According to the present invention, in the precision casting process, nickel particles, pure iron, tungsten iron, silicon iron, and chromium are added into a high-temperature furnace. The nickel particles and the pure iron melt first to forrn an alloy that reduces the melting point of the tungsten iron. Thus, the tungsten iron having a high melting point melts in the furnace without causing sedimentation of tungsten. Next, appropriate sampling test and control are proceeded to form molten WFeNi alloy comprising nickel 30–60 wt %, tungsten 15–30 wt %, chromium 1.5–10.0 wt %, and iron that is the remaining portion.

Referring to FIG. 4, when manufacturing the alloy, chromium of 1.5%–10% by weight is added to avoid precipitation of pearlite structure from the γ (iron, nickel) phase of the WFeNi alloy that forms the weight member and to improve precipitation of uniformly distributed carbonide, thereby improving the rust-resisting property. During spray testing at 40° C. for 24 hours (which simulates a highly corrosive environment) to the WFeNi alloy by using NaCl solution of 5% by weight, the rusted area of the WFeNi alloy is merely 1% of the overall surface area of the WFeNi alloy.

Referring to FIG. 5, during manufacture of the alloy, the molten mixture ratio of tungsten to nickel is maintained below the solidus curve of the γ (iron, nickel) phase. Thus, the tungsten can completely solve as a solid solution in the nickel of a sufficient amount. The solidus curve of nickel and tungsten satisfies the following equation:

$$Y=1.26x-38.99\%$$

wherein Y is the percentage of tungsten by weight, and Y is not less than X. For example, if nickel in the alloy is 51.78%, the nickel amount is sufficient to solidly solve tungsten of 19.6%. On the other hand, if nickel in the alloy is 55%, the nickel amount is sufficient to solidly solve tungsten of 30.3%. Thus, precipitation of tungsten in the γ (iron, nickel) phase of the WFeNi alloy made weight member, which prevents generation of patterns on the surface of the WFeNi alloy. Since the surface of the weight member may provide improved shining finishing uniformity, the insertion line between the weight member and the golf club head body can hardly be seen when the weight member is directly engaged to (particularly by embedding) the surface of the golf club head body and then polished. Thus, the engaging difference between individual golf club head body and the weight member can be avoided, and the processing conditions can be controlled to be the same. Accordingly, the added value and the engaging/assembling tolerance of the weight member are increased.

Further, the flowability during casting can be improved by means of adding silicon less than 1.5%.

Further, an appropriate amount of manganese iron, copper, vanadium iron, and niobium iron can be optionally added after adding of chromium. The mechanical properties of the weight member, the flowability during casing, and removal of gas are improved when at least one of Mn of less than 1.0%, Cu of less than 4.0%, V of less than 1.0%, and Nb of less than 1.0% is added.

Further, the density of the WFeNi alloy made weight member for a golf club head in accordance with the present invention can be selected according to different uses of different golf club heads. Preferably, the density of the weight member is 9.0 g/cm$^3$–10.5 g/cm$^3$, and the melting point of the weight member is 1400° C.–1500° C. (2552° F.–2732° F.), preferably 1455° C. (2651° F.).

The nickel particles, pure iron, chromium, and molybdenum mentioned above mean pure metal (including small amount of impurities) of nickel, iron, chromium, and molybdenum, respectively. The tungsten iron, silicon iron, manganese iron, vanadium iron, and niobium iron mean ferroalloy of tungsten, silicon, manganese, vanadium, and niobium, respectively. During the precision casting, the amount of tungsten, silicon, manganese, vanadium, and niobium are so adjusted based on the contents of the tungsten iron, silicon iron, manganese iron, vanadium, iron, and niobium iron that the molten alloy of WFeNi satisfies the above-mentioned proportion for making the weight member. Further, the WFeNi alloy may contain trace elements such as carbon of less than 0.1%, sulfur of less than 0.1%, and phosphorus of less than 0.1%.

According to the above, the disadvantages of the weight member made by the conventional precision casting process are obviated and/or mitigated by the precision casting process in accordance with the present invention. The physical/chemical properties of the weight member are improved by means of adding chromium and molybdenum as well as controlling the mixture ratio of nickel to tungsten. The rust-resisting property, uniformity of the shining finishing, appearance, and the assembling tolerance of the weight member are improved.

While the principles of this invention have been disclosed in connection with its specific embodiment, it should be understood by those skilled in the art that these descriptions are not intended to limit the scope of the invention, and that any modification and variation without departing the spirit of the invention is intended to be covered by the scope of this invention defined only by the appended claims.

What is claimed is:

1. A weight member for a golf club head, the weight member being made by a WFeNi alloy manufactured by means of a precision casting process, the WFeNi alloy comprising nickel 30–60 wt %, tungsten 15–30 wt %, chromium 1.5–10.0 wt %, and iron; wherein the tungsten is used to adjust a desired weight of various golf club heads and said percentage of the chromium ranges between 1.5–10.0 wt % that can avoid precipitating a pearlite structure in a γ (iron, nickel) phase of the weight member and reduce manufacture cost.

2. The weight member for a golf club head as claimed in claim 1, wherein the mixture ratio of molten tungsten to molten nickel satisfies a solidus curve as follows:

$$Y=1.26x-38.99\%$$

Wherein Y is the percentage of tungsten by weight, and Y is not less than X.

3. The weight member for a golf club head as claimed in claim 1, further comprising silicon of less than 1.5%.

4. The weight member for a golf club head as claimed in claim 1, further comprising at least one component for improving a mechanical property of the weight member.

5. The weight member for a golf club head as claimed in claim 4, wherein said at least one component includes manganese of less than 1.0%, copper of less than 4.0%, vanadium of less than 1.0%, and niobium of less than 1.0%.

6. The weight member for a golf club head as claimed in claim 1, wherein the WFeNi alloy has a density of 9.0 $g/cm^3$–10.5 $g/cm^3$.

7. The weight member for a golf club head as claimed in claim 1, wherein the WFeNi alloy has a melting point of 1400° C.–1500° C.

8. The weight member for a golf club head as claimed in claim 1, further including at least one trace element.

9. The weight member for a golf club head as claimed in claim 8, wherein said at least one trace element includes sulfur of less than 0.1%, phosphorus of less than 0.1%, and carbon of less than 0.1%.

10. A weight member having a configuration for engagement with a golf club head wherein said weight member is made by casting a WFeNi alloy in a precision casting process to produce said configuration, said alloy comprising 30–60 wt. % nickel, 15–30 wt. % tungsten, 1.5–10 wt. % chromium, and iron; with the proviso that said precision casting process takes place under conditions to prevent a pearlite structure from being precipitated in a γ (iron, nickel) phase of the WFeNi alloy.

11. A golf club head which comprises a weighted member engaged therewith, said weighted member being made by casting a WFeNi alloy in a percision casting process; said alloy comprising 30–60 wt. % nickel, 15–30 wt. % tungsten, 1.5–10 wt. % chromium, and iron; with the proviso that said percision casting process takes place under conditions to prevent a pearlite structure from being precipitated in a γ (iron, nickel) phase of the WFeNi alloy.

* * * * *